US005956931A

United States Patent [19]

Stork

[11] Patent Number: 5,956,931

[45] Date of Patent: Sep. 28, 1999

[54] APPARATUS FOR WRAPPING PRODUCTS

[75] Inventor: Brian R. Stork, Washington, Mo.

[73] Assignee: Stork Fabricators, Inc., Washington, Mo.

[21] Appl. No.: 08/936,042

[22] Filed: Sep. 23, 1997

Related U.S. Application Data

[63] Continuation-in-part of application No. 08/748,290, Nov. 13, 1996, abandoned.

[51] Int. Cl.[6] ..... B65B 9/06; B65B 51/10

[52] U.S. Cl. ..... 53/550; 53/568

[58] Field of Search ..... 53/550, 548, 568, 53/562, 450, 455, 459

[56] References Cited

U.S. PATENT DOCUMENTS

| | | | |
|---|---|---|---|
| Re. 27,977 | 4/1974 | Monaghan . | |
| Re. 30,010 | 5/1979 | Shanklin | 53/552 |
| 3,355,857 | 12/1967 | Tobey | 53/553 X |
| 3,508,378 | 4/1970 | Fehr et al. | 53/553 X |
| 3,552,088 | 1/1971 | Niwa | 53/374.4 X |
| 3,720,565 | 3/1973 | Cavanna | 53/374.4 X |
| 3,765,990 | 10/1973 | Histed et al. | 53/374.4 X |
| 3,791,101 | 2/1974 | Monaghan | 53/210 |
| 3,914,917 | 10/1975 | Young | 53/374.4 X |
| 4,110,954 | 9/1978 | Olsson et al. | 53/450 |
| 4,185,443 | 1/1980 | Budzyn | 53/550 |
| 4,211,599 | 7/1980 | Bolter et al. | 53/374.4 X |
| 4,219,988 | 9/1980 | Shanklin et al. | 53/550 |
| 4,260,447 | 4/1981 | Muscariello | 53/374.4 X |
| 4,537,016 | 8/1985 | Shanklin et al. . | |
| 4,658,569 | 4/1987 | Hanagata | 53/550 |
| 4,870,802 | 10/1989 | Cerf | 53/442 |
| 4,903,460 | 2/1990 | Ballestrazzi et al. | 53/550 |
| 4,939,889 | 7/1990 | Watanabe | 53/450 |
| 5,001,884 | 3/1991 | Hanagata | 53/568 X |
| 5,329,745 | 7/1994 | Suga | 53/550 X |
| 5,341,623 | 8/1994 | Siegel | 53/550 X |
| 5,371,999 | 12/1994 | Hansen et al. | 53/550 X |
| 5,381,640 | 1/1995 | Chiu | 53/550 X |
| 5,417,041 | 5/1995 | Hansen et al. | 53/550 |
| 5,444,964 | 8/1995 | Hanagata | 53/550 |
| 5,603,202 | 2/1997 | Hanagata | 53/550 |
| 5,675,958 | 10/1997 | Shanklin et al. | 53/550 X |

*Primary Examiner*—James F. Coan

*Attorney, Agent, or Firm*—Polster, Lieder, Woodruff & Lucchesi, L.C.

[57] ABSTRACT

Apparatus for supplying plastic wrapping film from a supply roll in which the film is folded to have a closed side edge and plies of the film open along an opposite side. The wrapping film is conveyed simultaneously with a stream of predetermined size product through a hot wheel to seal the open plies and form a tube enclosing the product, after which the tube and enclosed product is fed into a film sealing apparatus which cross seals and cuts the plastic tube transversely of its line of movement in a moving cycle in which the plastic tube is cut and sealed with the products individually wrapped and discharged. The film sealing apparatus is adjustable to be able to accommodate changes in the dimensions of products to be wrapped.

4 Claims, 11 Drawing Sheets

APPARATUS FOR WRAPPING PRODUCTS

CROSS-REFERENCE TO RELATED APPLICATIONS

This application is a continuation-in-part of prior application Ser. No. 08/748,290, filed Nov. 13, 1996, abandoned, entitled APPARATUS FOR WRAPPING PRODUCTS.

STATEMENT REGARDING FEDERALLY SPONSORED RESEARCH OR DEVELOPMENT

Not Applicable.

BACKGROUND OF THE INVENTION

The invention relates to apparatus for providing a folded thermoplastic film with open side margins movable in a linear direction to receive a product between the folded plies of the film so that the open side edges of the film plies can be sealed in advance of cross sealing the film at the leading and trailing ends of each product.

The wrapping of products in a thermoplastic film is well known in the prior art represented by Watanaba U.S. Pat. No. 4,939,889 of Jul. 10, 1990 and by prior examples of apparatus such as Shanklin et al. U.S. Pat. No. 4,219,988 of Sep. 2, 1980, or Monaghan Re 27977 of Apr. 23, 1974. The apparatus of these items of prior art offer difficulties in moving the wrapping film at economical speed, and the apparatus is subject to mechanical stress when operated at speeds that meet needs of the product wrapping industry.

BRIEF SUMMARY OF THE INVENTION

The object of the invention is to simplify the operation of product wrapping by separating the operation of wrapping products into apparatus which establishing the mating of products between the folded plies of thermoplastic film so the edges of the plies can be easily and quickly sealed, and thereafter the product partially wrapped between the film plies can be advanced into apparatus which cross seals the film plies at the leading and trailing ends of a substantially continuous flow of products in wrapping film.

A further object is to provide apparatus that can effectively wrap products which are moved in a linear direction of travel so that the sealing of the product in film plies can be completed in a continuous wrapping operation which eliminates the possibility of vibration and rapid wear while obtaining useful product wrapping speeds.

Yet another object is to provide apparatus for wrapping product of uniform size and thickness and to be able to quickly adjust the apparatus by external manual means to accommodate for products having a change in thickness.

Still a further object is to provide apparatus for wrapping products while on the "fly" and to arrange a system of moving such products in which a spring operated cam is incorporated to drastically reduce wear in clutch-brake controls for smooth motion when the apparatus is operating with a substantially continuous flow of wrapping film enclosed products.

These and other objects of the invention will be set forth in the following detailed description of a preferred embodiment.

DETAILED DESCRIPTION OF THE INVENTION

Figure 1:
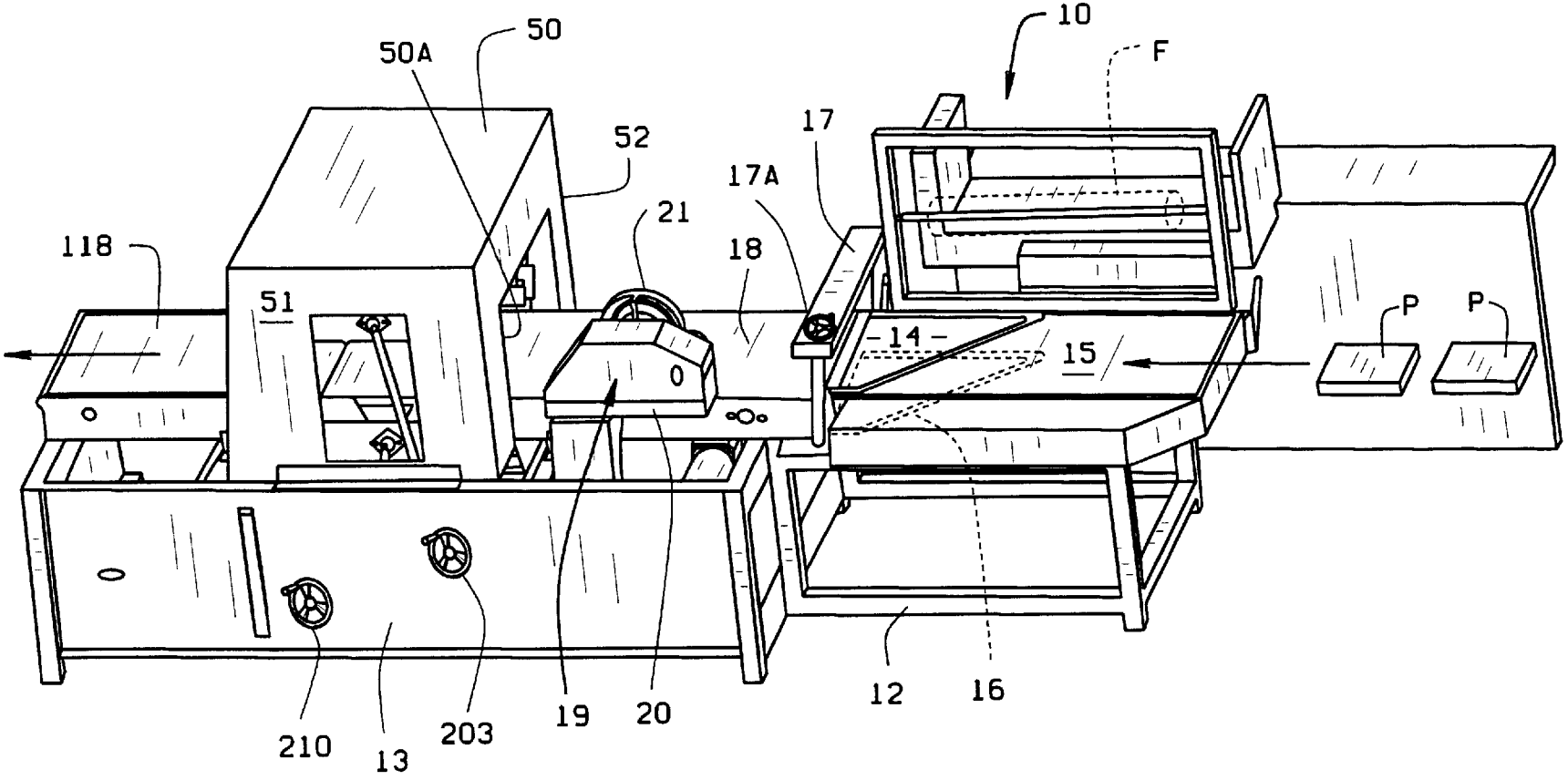
FIG. 1 is an elongated perspective view of apparatus for wrapping products in thermoplastic film in a longitudinal arrangement of components.

The view of FIG. 1 illustrates the overall assembly of the apparatus which include support frames 12 and 13 for handling thermoplastic film F which has been prepared in roll form and initially moved while in folded condition so that the plies reaching into the conveyor 15 need to be separated. The plies are directed into inverting head 14 overlying a product feed conveyor 15 and the second inverter head 16 is positioned beneath the conveyor 15. In this arrangement, the film plies are separated so products moving on the conveyor 15 is inserted between a top ply from inverter head 14 and a bottom ply from the inverter head 16. The spacing between the film plies from heads 14 and 16, including the thickness of the conveyor 15, as well as the heads are selected to suit the thickness of the product. The vertical adjustment of the inverter head 14 under goes an adjustment relative to conveyor 15 by manual hand wheel 17A.

After the film plies have been separated by inverting means 14 and 16 so a product can be received, the bottom ply from inverting head 16 must be threaded up in the space between the end of conveyor 15 and conveyor 18 so it rests on top of the receiving end of conveyor 18. Thus the separated plies of the film F will be moved over the conveyor 18 and held in separated positions by the presence of the first of a flow of products P moved in under the inverting head 14 and on top of the bottom ply threaded up from the bottom inverting head 16. The side edges of the top and bottom plies of the film F will be fed into a side seal mechanism 19.

In order to simplify the drawings disclosure, the products P in FIG. 1 can be understood to represent either a continuous flow of such products which are not drawn into the mechanism, or the products can be fed in an individual manner.

The Film Side Seal Mechanism

Figure 2:
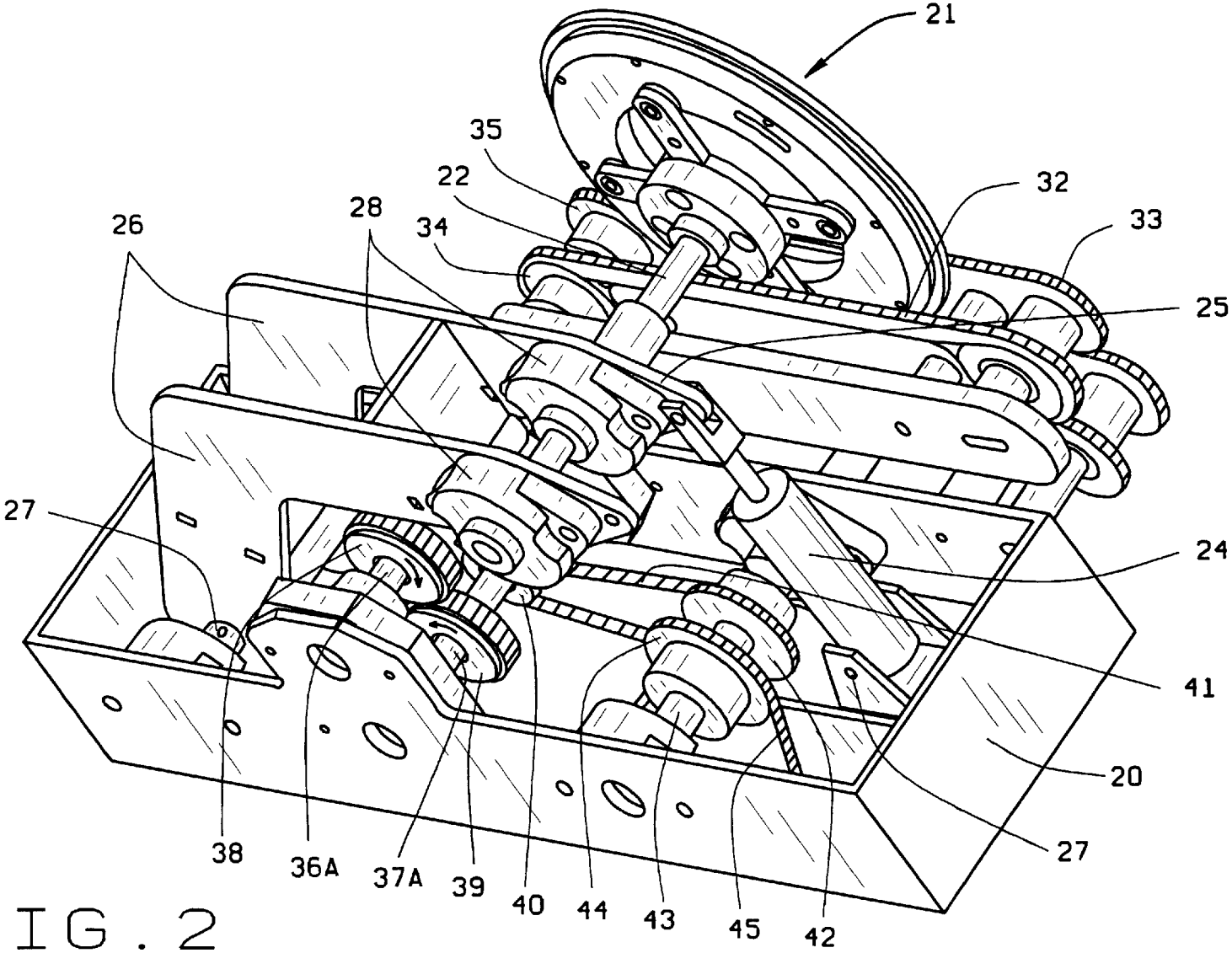
FIG. 2 is a perspective view of apparatus for applying a seal in the alignment of side edges of the film ply to establish a first closing stage in the wrapping which places the product in a film tube.
Figure 3A:
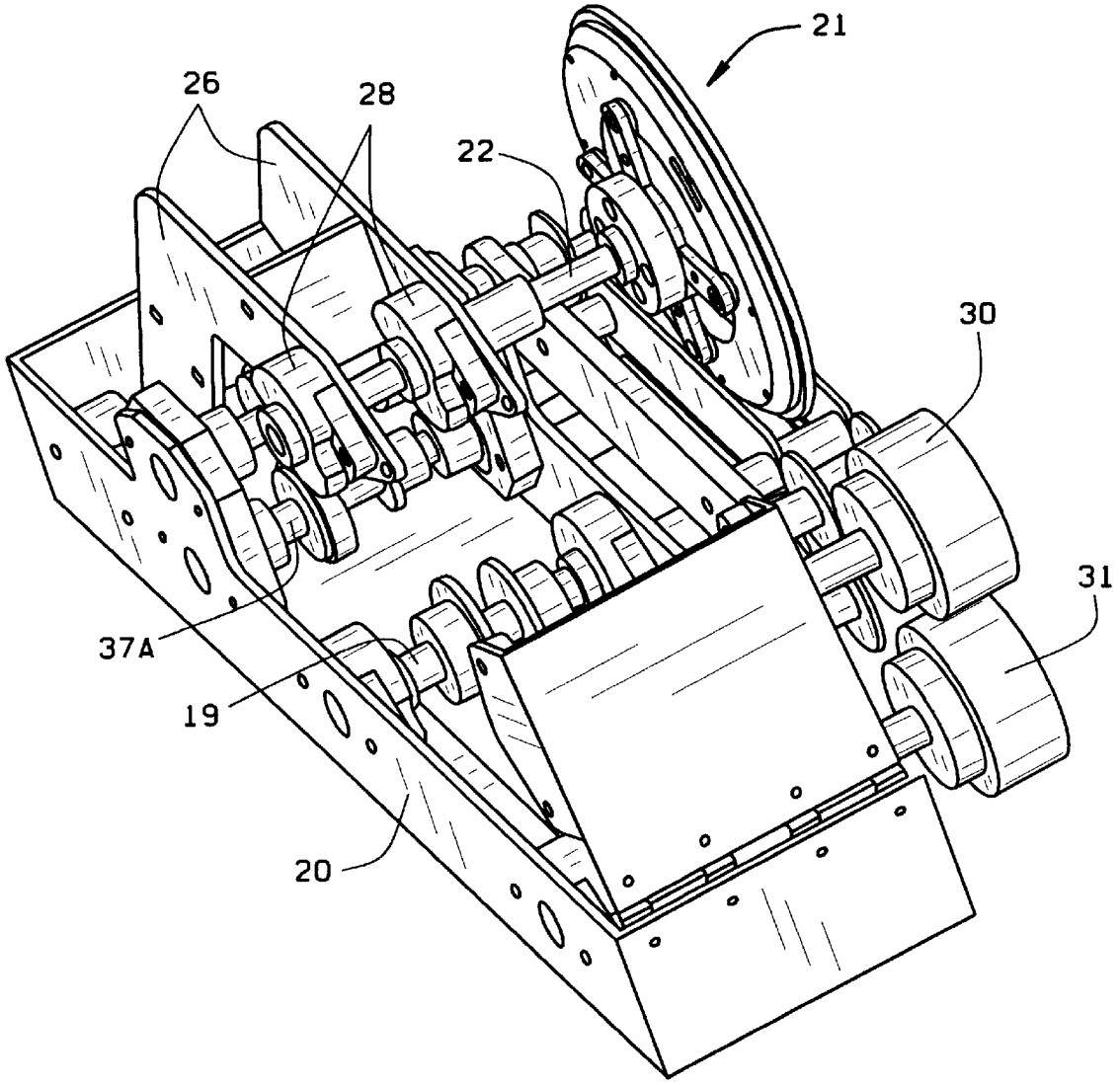
FIGS. 3A and 3B are top and side views of portions of wrapping apparatus seen in perspective of side seal in the wrapping film which effects a continuous operation of sealing and trimming the side seal for the film containing products.
Figure 3B:
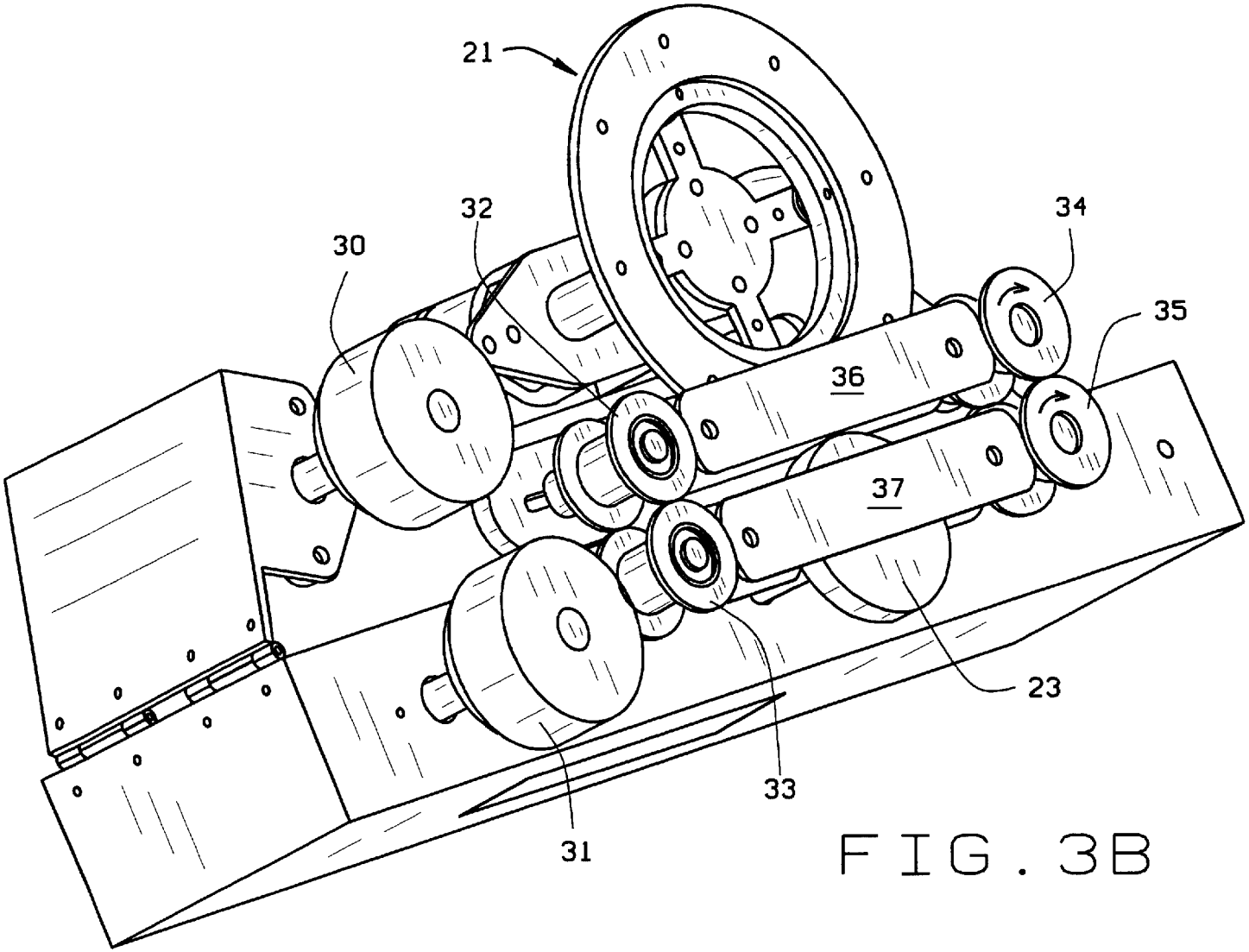

Attention will now be directed to the views of FIGS. 2, 3A and 3B. A frame 20 is provided to support the side seal mechanism which consists of a hot seal wheel 21 which is freely rotatable on a shaft 22 in position to be engaged on top of a drive roller 23 (FIG. 3B). When the hot seal wheel 21 is not being used to engage the film F for sealing and trimming the side edges of the film, it can be elevated above the drive roller 23 by actuator air cylinder 24 (FIG. 2) engaged with the arm 25 of a frame having two arms 26 carried on a pivot shaft 27 in the frame 20. That frame 26 carries the shaft 22 and is provided with suitable bearings 28 for the shaft 22.

The overlying side edges of the film plies F (not shown) are manually placed in overlapping alignment at the start of a side sealing operation. These plies with a product between the plies are fed between rolls 30 and 31 (FIGS. 3A and 3B). The aligned film edges are fed into powered pulling belts 32 and 33, although one belt 32 may be sufficient. These belts 32 and 33 are powered by rolls 34 and 35 (see FIGS. 2 and 3B). The sets of rolls 32 and 33 with sets of rollers 34 and 35 are supported in suitable frames 36 and 37 (see FIG. 3B). The hot wheel 21 is positioned between the belts 32 and 33 so that the film F can be held in a flat condition to avoid the formation of wrinkling voids during the hot sealing and trimming of the side edges.

The drive for the belt pulling rollers 34 and 35 is seen in FIG. 2 where a shaft for the upper roller 34 is seen at 36A and the shaft 37A for the lower roller 35 is seen also. The shafts 36A and 37A carry gears 38 and 39 which drive the shafts in directions to pull the belts 32 and 33 which feed the film edges under the hot wheel 21 and on top of the roller 23 (see FIG. 3B). Shaft 37A is powered by a drive sprocket 40 on that shaft 37A connected by belt 41 to a sprocket wheel 42 on shaft 43. That shaft 43 carries a driven sprocket 44 engaged by a power actuated belt 45 engaged on a sprocket 46 on the powered shaft 48 (see FIG. 5).

Film Cross Seal and Separation Device

The apparatus of FIG. 1 is further provided, in addition to the side sealing assembly 19 of film plies, with means operable in housing 50 so a cross cutting and sealing operation of the film occurs while the film is moving. Thus the cross cutting and sealing is accomplished on the "fly".

The cross cutting and sealing device is disclosed in FIGS. 1, 4, 5, 6, 7 and 8, and reference will be directed to these views during the description thereof.

Figure 4:
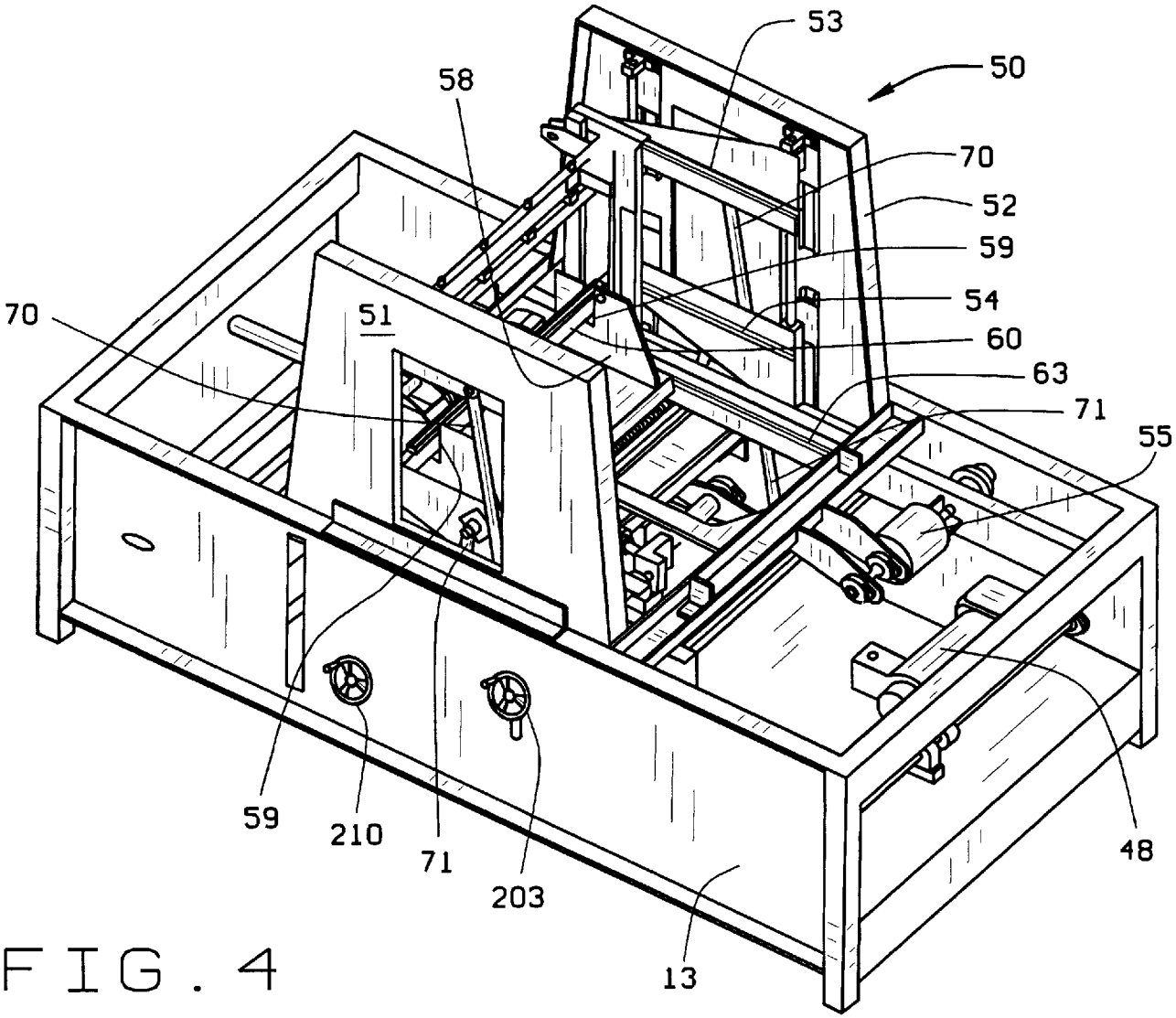
FIG. 4 is a perspective view of a further portion of the apparatus of FIG. 1 with the structural components uncovered to reveal the nature of the operating components.
Figure 5:
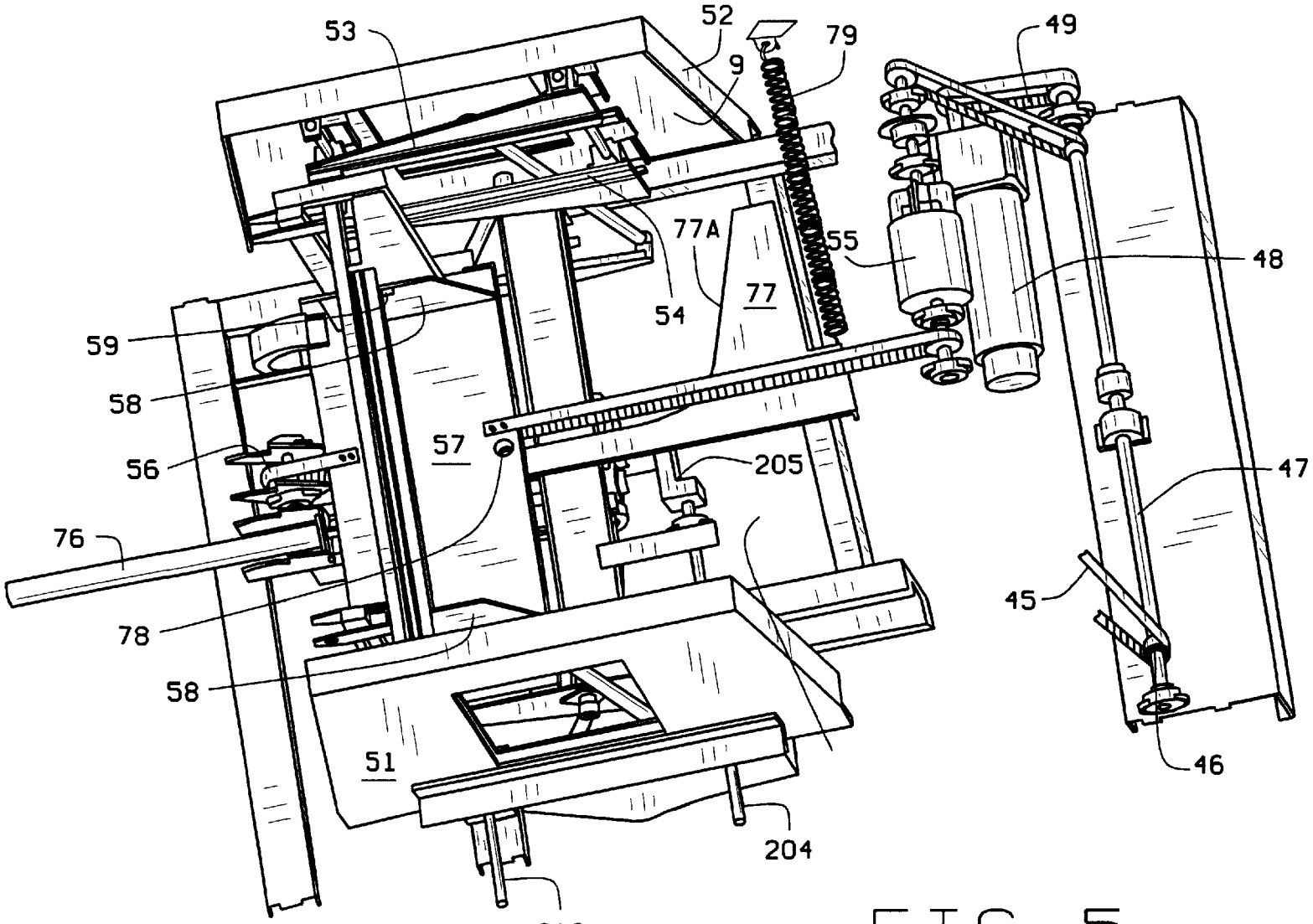
FIG. 5 is a fragmentary perspective view as seen from the end of the operating components associated with the view of FIG. 4 when seen in further expanded view with certain structure removed to clarify the operating components.

The perspective view of FIG. 4 is the assembly 50 from FIG. 1, but seen with the product moving conveyor 18 and its discharge companion conveyor 118 of FIG. 1 removed to illustrate underlying mechanism of the assembly in the frame 13. The side seal device 19 enclosed in cover 20 of FIG. 1 has also been removed, although the drive motor 48 remains. The frame 13 carries a housing for the cross cut assembly 50 (see FIG. 1) of which side walls 51 and 52 are retained because these side walls each carry upper and lower tracks 53 and 54 respectively. The principal electric motor 48 has its drive shaft 47 which, in turn, drives a belt 49 for operating a clutch/brake mechanism 55. The mechanism 55 is connected by a belt 56 to a frame which incorporates an operable means in the form of slide pan 57 movable on the lower track 54 by reason of the pan 57 being equipped with side wall panels 58. These side panels 58 are slotted (FIGS. 4 and 7) at 59 to allow for the installation of the ends of a bar 60 to seat in those slots 59 and also connect by end slides 61 (FIG. 6) which engages in the lower one of the horizontal tracks 54 carried in the side walls 51 and 52 (FIG. 5).

Figure 6:
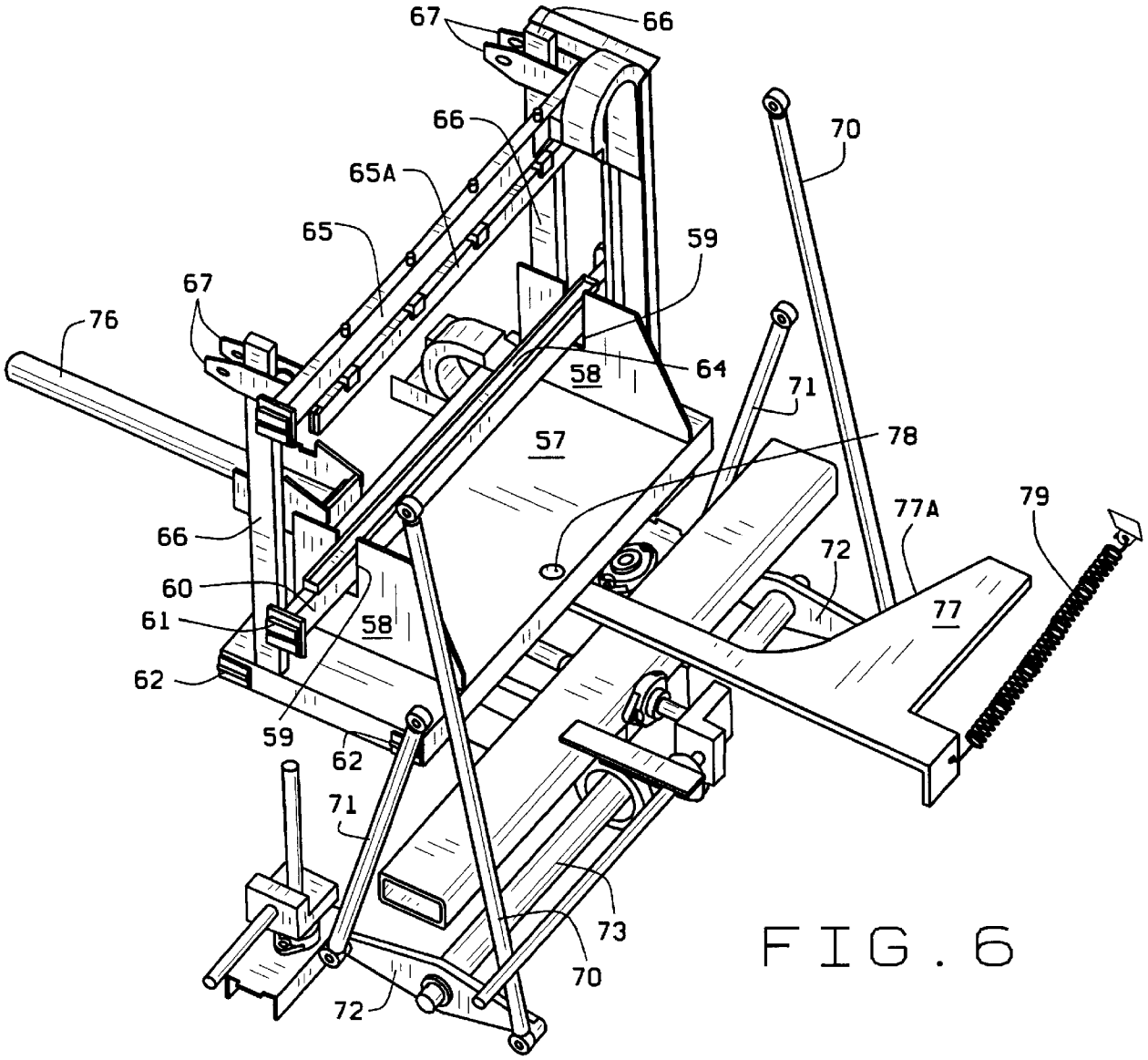
FIG. 6 is an exploded perspective view of the cross sealing mechanism initially seen in FIG. 5 for sealing the product in its wrapping film.

Also as seen in FIG. 6 a frame consisting of the slide pan 57 has its opposite sides 54 (FIG. 6) equipped with slide elements 62 which engage in horizontal tracks 63 (see FIG. 4) so that the belt 56 (FIG. 5) can move the operable means or pan 57 along horizontal tracks 63 and cause the vertical posts 66 (FIG. 6) of the frame to guide the movement of the jaws 67 (see FIG. 6) to move the bar 60 in the same horizontal direction of the pan 57. That bar 60 supports a flat platen element 64 which acts as a surface on which second bar 65 (FIG. 6) can actuate a hot knife bar 65A to abut with the platen 64 when performing the required cross cut and seal in the film F. In order for the hot knife bar 65A to maintain proper vertical alignment with the platen bar 64, the frame slide pan 57 carries vertically directed posts 66 so alignment guides 67 on the bar 65 can slide vertically relative to the posts 66 when the bar 65 is brought down against the platen 64. It can be understood from the views of FIGS. 6 and 7 that the cut and seal bars 64 and 65A are moved in horizontal directions frame with the pan 57 at all times.

Figure 7:
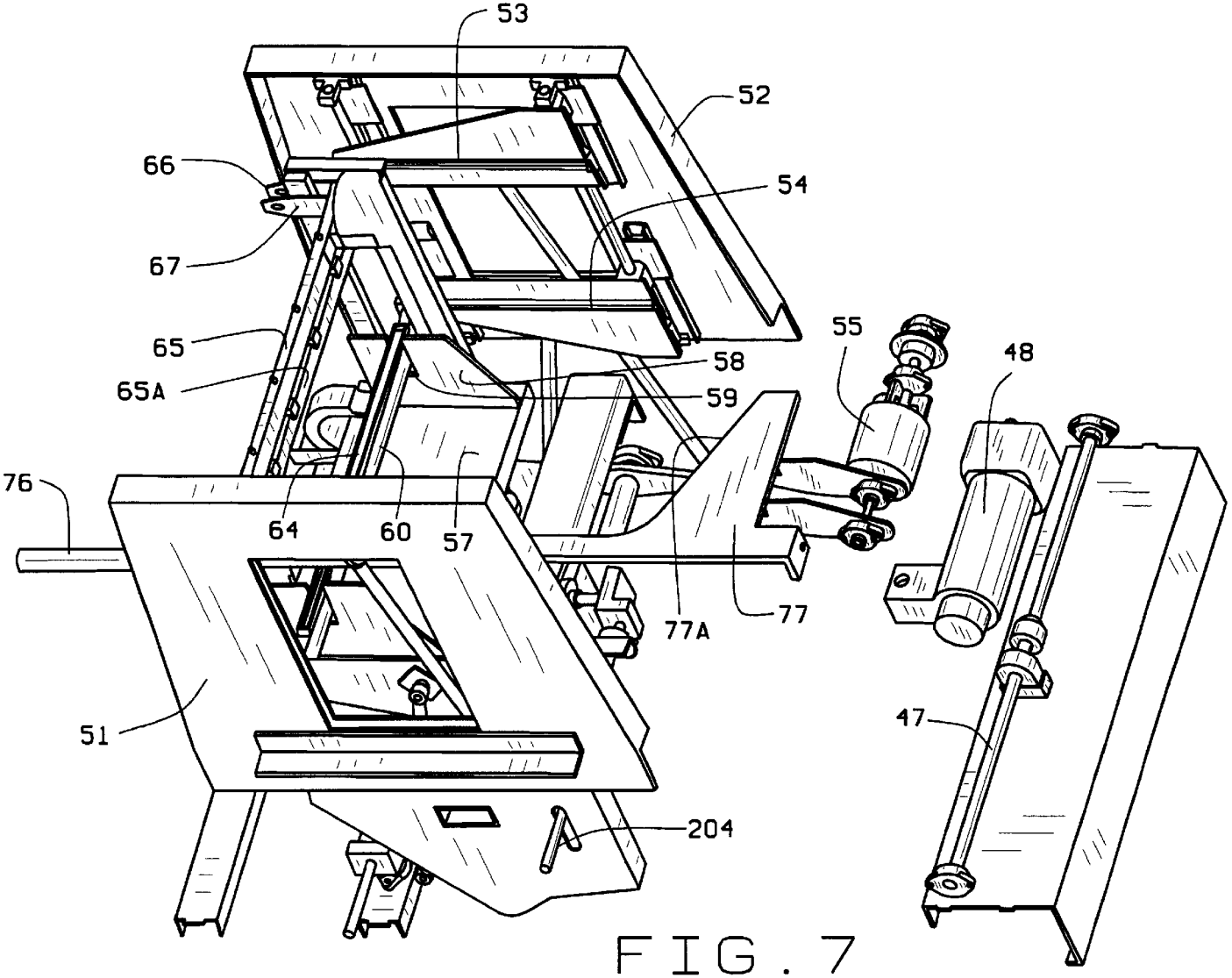
FIG. 7 is a further exploded perspective view of the mechanism in FIG. 6 for sealing and cutting the product wrapper.
Figure 8:
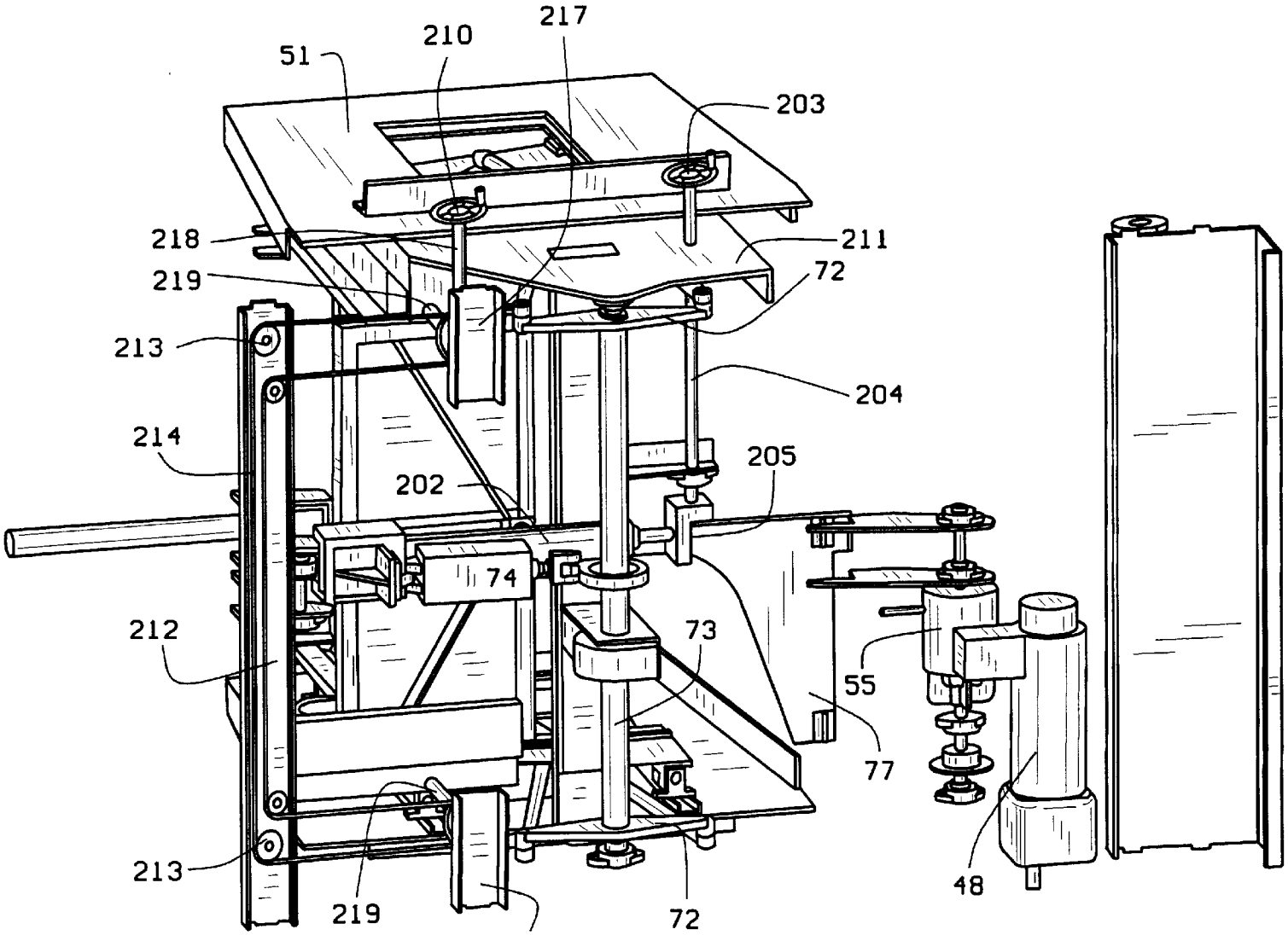
FIG. 8 is an exploded view from the under side of the mechanism shown in FIG. 5.

In FIGS. 6, 7 and 8, and other views, the vertical spacing of tracks 53 and 54 is controlled by the push-pull rods 70 for the upper tracks 53 and push-pull short rods 71 for the lower track 54. These respective push-pull rods are actuated by rocker arms 72 (FIGS. 6 and 8) and the rocker arms 72 are actuated by the rotation of a common shaft 73 under the control of an air cylinder 74 (see FIG. 8). The actual position of the cylinder 74 and the rotated position of shaft 73 can be quickly adjusted by rotating the hand wheel 203 (see FIGS. 1 and 8) on shaft 204 through bevel gear unit 205. Rotation of shaft 73 changes the spacing between the hot knife 65A and its platen 64 to accommodate changes in the thickness dimension of the product to be wrapped.

The desired cut and seal operation exercised on the film F to isolate each product between the opposite end seals while moving on the fly operation of the conveyor positions 18 and 118 is seen in several views of the drawings, particularly FIGS. 4, 5, 6, 8 and 10. It is first understood that cross sealing and cutting takes place between a substantially continuous movement of the product flow in the enclosing film tube as a result of the side sealing assembly 19 which forms that tube. The cross sealing and cutting must be performed in the space G after the side seal device 19 has performed its function and has released the side sealed film and enclosed products so that the enclosing film tube can be moved by conveyor 18 into the cross seal and cut device 50 (see FIG. 1). That device 50 houses mechanisms which must be actuated so the feed conveyor 18 and the cooperating discharge conveyor 118 have been adjusted in motion to bring the platen bar 64 and the overhead hot seal and cutting bar 65 up to the entrance between sides 51 and 52 of the device 50. This is necessary so the cut and seal function can be performed on the film tube at the normal speed of the conveyor portions 18 and 118. Thus during that linear movement the air cylinder 74 (FIG. 8) can rotate the shafts 73 to adjust the rocker arm 72 to bring the platen 64 up and the cut and seal bar 65 down while these bars move horizontally at the same longitudinal speed of the conveyor 18 and 118. To accomplish this uniform movement the clutch function of the clutch/brake 55 must operate through the belt 56 (FIG. 5) to pull the operable pan 57 toward the discharge conveyor 118 from the housing 50. The part 57 movement establishes the movement of the bars 64 and 65 and concurrently the air cylinder 74 (FIG. 8) has rotated shaft 73 to bring the bars 64 and 65 into abutment to seal and hot cut the film at the leading end of a product first to enter the housing 50.

Once that seal and cut is performed at the leading end of the film tube enclosing the product, the bars 64 and 65 must be separated and the operable means 57 must be rapidly retracted to meet the next product advancing on the conveyor 18. The bars 64 and 65 can again be closed behind the lead product so the tube can be cross cut and sealed at the leading products rear end. That cross seal forms the lead end of the next product and can encounter a cross cut and seal at its leading end. Thus, the mechanism in the housing 50 can be repeatedly operated so that sealed product can be removed from the conveyor 118. The rapid return of the operable means 57 (FIG. 6) is energized by the air horizontal cylinder 76, and on the return to its starting home position there is a motion control cam plate 77 that functions through the presence of a roller pin 78 (see FIGS. 5 and 6) on the pan 57 to engage the cam contoured shaped surface 77A and at the same time to try and expand a spring 79 which applies an opposing force exerted by the pin roller 78 to apply a braking load and bring the operable means 57 to a positional stop at the proper location.

At this proper stop position of the pan 57, the force of the air cylinder 76 is in equilibrium with the force of the spring 79. FIG. 5 shows the pin 78 on the pan 57 aligned to engage the cam surface 77A which pushes the cam in a lateral direction to stretch the spring 79 and when the pan reaches the position where the platen and hot knife are at the entrance 50A, there is equilibrium with the force of the spring and the thrust of cylinder 76. At this position the brake side of the clutch/brake device 55 (FIGS. 4 and 5) is engaged to hold the motion of the pan 57 substantially steady into its home position, this brake engages via an electrical switch (not shown) when the next product enters at 50A the cross cut and seal mechanism is ready. The air cylinder 76 is now de-energized, so the air cylinder 76/spring 79 system now is not in equilibrium and the brake device 55 is released to allow spring 79 to force pan 57 to move in the exiting direction of the traveling product toward conveyor 118, and simultaneously the clutch portion of the device 55 allows the belt 56 to move the pan 57 by bars 64 and 65A is complete, whereupon the clutch portion disengages and the air cylinder rapidly returns the motion pan 57 to the home position. At this point the cycle begins again. The division of operation between the clutch/brake device 55, the spring responsive on cam 77 and the air cylinder 76 reduces the wear on the device 55 so an extended useful life is obtained.

Turning again to FIGS. 8 and 9, it can be seen that a frame channel member 212 carries sprockets 213 which are interconnected by a chain 214. The sprockets 213 in channel member 212 are connected by chains 214 to the bevel gear units 216 carried in the spaced short sections of channels 217 (see FIG. 9). One of the bevel gear units 216 is connected to a shaft 218 on which a hand wheel 210 is mounted to be exposed at the frame 13 (see FIG. 1). That hand wheel 210 is provided to permit the gear units 216 to simultaneously rotate a pair of screw shafts 219 (see FIG. 9) which raises or lowers a flange 220 on the side frames for quick adjustment of the frame for tracks 53 and 54 carrying the hot bar 65 and the platen bar 64 so that the assembly carrying those bars can be adjusted to suit whatever thickness size is assumed by the product at it is run through the apparatus for wrapping with the plastic film.

Figure 9:
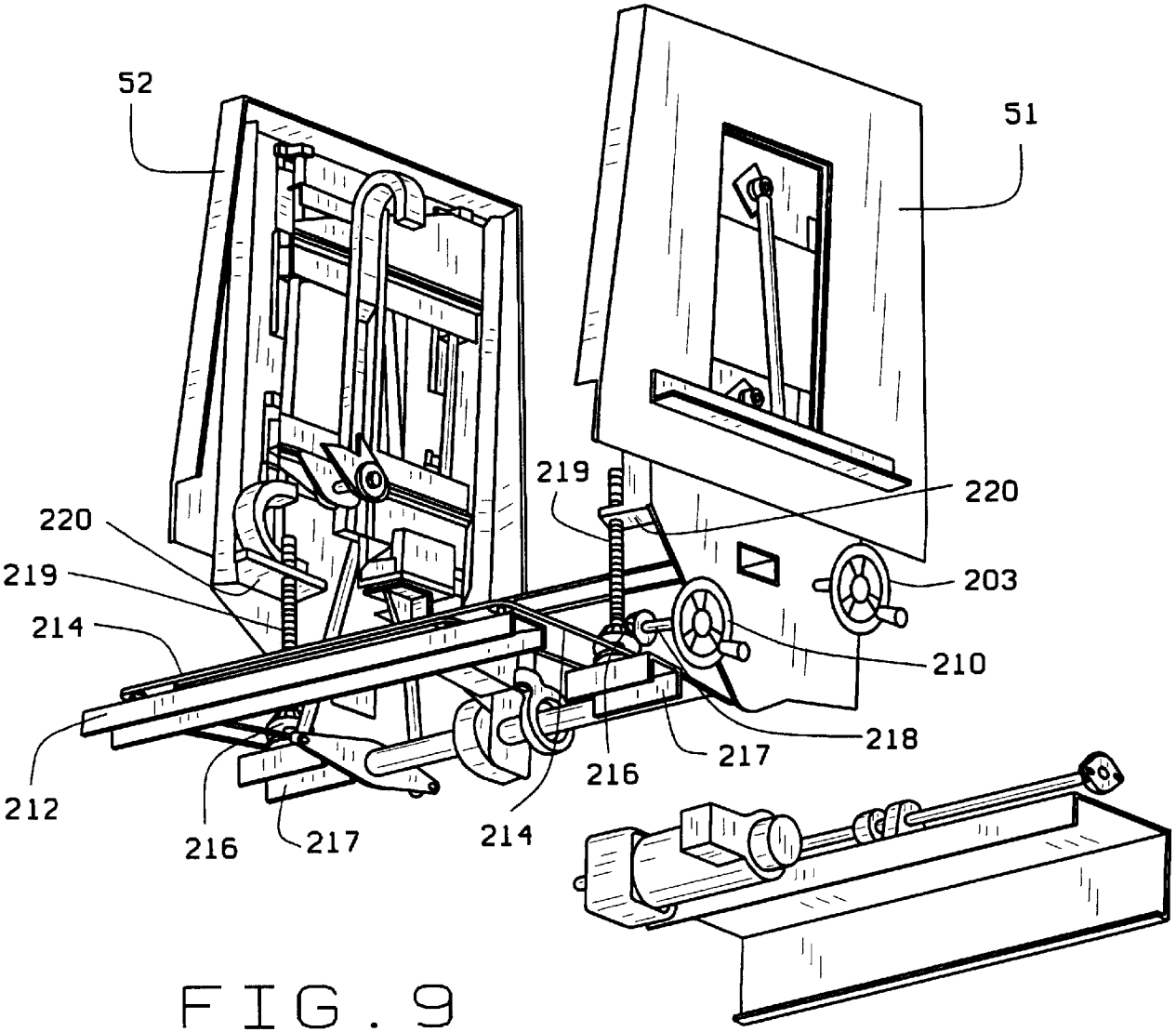
FIG. 9 is an end view of the assembly of FIG. 8.

There is further shown in FIGS. 8 and 9 a hand control wheel 210 which operates a bevel gear unit 216 and a sprocket gear 213, and by means of a belt 214 connecting a second sprocket gear 213 in the opposite side. These gear units 213 and 216 are provided to make adjustments in the position of the cross seal and cut mechanism to rapidly adapt the latter mechanism for any change in the thickness of a run of products so the platen 64 and hot knife 65A can perform their function at a level which is substantially at the mid position of the thickness of the product in a run.

Figure 10:
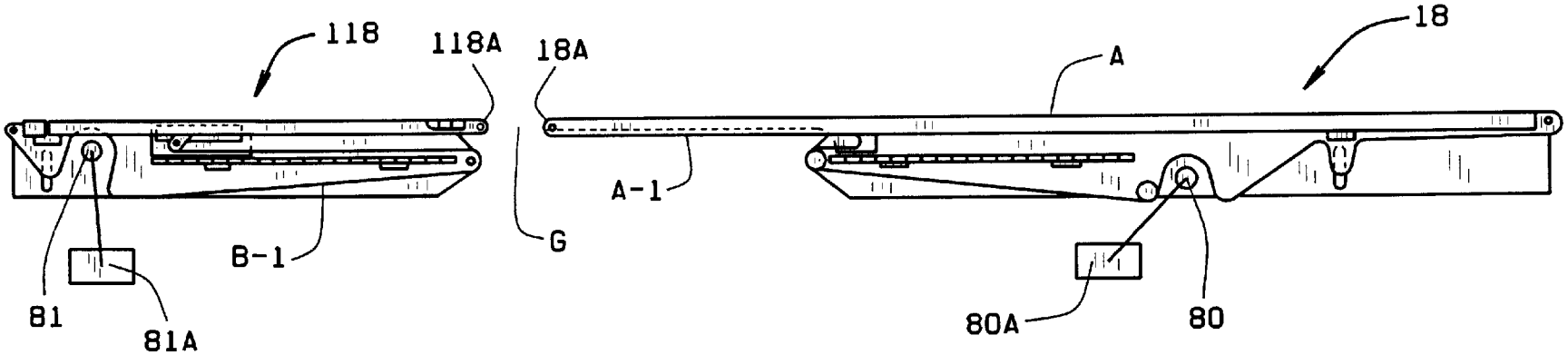
FIG. 10 is a longitudinal elevation of a conveyor mechanism capable of responding on the "fly" when employed in the unit seen in FIG. 1.

It is understood that the conveyor system of 18 and 118 seen in FIG. 1 is further shown in FIG. 10. The purpose for the conveyor 18 and 118 is to accommodate the operation of the cut and seal mechanism in the housing 50 to be able to cut and seal the individual products moving in spaced apart position in a wrapping film that is partially cut and sealed along one side at means 20 before the closed film tube reaches the housing 50. The product surface supporting portion 18 of the conveyor and the cooperating product surface supporting portion 118 extend for a given specific total length from the product entering end at conveyor 15 to the delivery end at portion 118. What is unique is that the cooperating ends 18A and 118A of these conveyors have to maintain a given space G to allow for the vertical rise and fall of the platen surface 64 on bar 60 (FIG. 6) while those spaced ends 18A and 118A must move horizontally at the same speeds to move each product from its leading sealed end near the housing entrance 50A and its sealed trailing end which occurs when the spaced between ends 18A and 118A passes the leading end of a wrapped product off to conveyor 118. Both conveyors 18 and 118 must then "fly" back to a start position relative to the tubular film which contains the next product.

To accomplish the conveyor function, there is a powered shaft 80 driven by motor 80A for conveyor 18 which pulls the product supporting surface of conveyor belt A in a direction to move the end 18A to the right by allowing the belt portion A-1 to move to the left thus allowing the conveyor 18A to shorten as the end 18A moves right. Concurrently a power shaft 81 driven by motor 81-A for moving the surface of conveyor B1 in a direction to move the end 118A to the right so it follows conveyor 18A which moves in a motion to shorten its surface while the power shaft 81 speeds belt B-1 to the right so it can accommodate lengthening need for conveyor belt 118 to allow movement of the end 118A to the right. It is understood that the total length of the load supporting portions 18 and 118 does not change a given overall length, but the gap space G between conveyors 18A and 118A does move back and forth at the rate of the cross cut and seal of the tubular film takes place within the housing 50.

In view of the foregoing description of the apparatus, it should now be understood that such apparatus is arranged to apply heat to sealable plastic film used to wrap a product. The apparatus is useful to handle a substantial flow of products supplied to a conveyor having a plastic sheet that is folded along one side edge and open along the opposite side edge where the plies of the film have been spaced to allow the insertion of the products. As the products (FIGS. 1 and 9) are inserted and moved by the conveyor 18, the open sides are heat sealed so the products are first sealed in the plastic sheet in a tubular form.

Once the products are partially wrapped in the plastic tube, that tube has its plies held spaced apart so each of the products is directed into a cross seal and cut mechanism 64 and 65A to effectively seal the tube at each leading end of each product and at the trailing end of the product. With the products separated, the seals for closing the trailing end of each product is actually the seal for the leading end of the next following product in a stream of many products to be wrapped individually. While the products can have like sizes, it is understood that in some cases differing product sizes according to thickness may be run through the assembly individually.

In the apparatus herein disclosed, there is a central control panel 221 (not shown) presenting an arrangement of controls for operating the conveyor for the mechanism in FIGS. 1 and 5, and for the conveyor motions in FIG. 10 and for associated controls which are normally well known in apparatus of the character herein disclosed. It is felt that the controls on such a panel 221 are well known and the circuits associated with the same have not been shown.

What is claimed is:

1. Apparatus for wrapping a product between the folded plies of a heat responsive film so the plies can be sealed to enclose the product in the film wrapping, the apparatus comprising:

a) a conveyor system having first and second conveyor portions defining a horizontal path for the movement of a product, said path having a predetermined gap spacing between said first and second conveyor portions;

b) means for depositing a product within the folded plies of said film on the first conveyor portion for movement over said gap spacing and onto said second conveyor portion;

c) film sealing and cutting means vertically operable in said gap across the movement of said conveyor system;

d) operable means to support said film sealing and cutting means in said gap spacing, said operable means having a movement from a first position in which said product within said folded plies approaches said gap space leading the product to a second position in which said product within said folded plies passes over said gap space to said second said conveyor;

e) powered means connected to said operable means to effect the movement thereof, said powered means including first means in the form of an air cylinder to locate said operable means in a home position, second means in the form of a belt drive to move said operable means from said home position, and braking means in the form of a spring loaded cam to determine the position of return of said operable means to said home position.

2. Apparatus for wrapping a product between the folded plies of a thermoplastic film so the plies can be sealed to enclose the product, the apparatus comprising:

a) a conveyor system having first and second conveyor portions movable horizontally while maintaining a predetermined gap spacing between the delivery end of said first conveyor portion and the receiving end of said second conveyor portions;

b) a frame having a horizontal pan and vertical posts thereon operably mounted to move horizontally with said conveyor system adjacent said predetermined gap spacing between said conveyor portions, said frame having guide posts;

c) heating sealing means carried by said frame posts in position to maintain a vertical alignment in said gap spacing, said sealing means including a film sealing and cutting bar and a cooperating vertically spaced platen bar in position to be engaged with said cutting bar with the folded plies of said film therebetween for effecting the sealing and cutting of the film plies;

d) means for depositing a product within said folded plies on said first conveyor portion to be moved from a first position by said first conveyor portion for travel across said gap space between said cutting bar and said platen bar including a pan for moving said pan in an exiting direction and for returning said pan to a home position and into a second position onto said second conveyor portion; and e) a manual control operatively positioned to adjust the spacing of said cutting bar and said platen bar to match the dimension of a product in a first vertical position to cut and seal the folded plies in the advancement of said folded plies ahead of the product travel across said gap space and operable to cut and seal the folded plies following the product horizontal movement across said gap space to enclose the product within the folded plies for product wrapping.

3. Apparatus for wrapping a product between the folded plies of a heat responsive film so the plies can be sealed to enclose the product in the film wrapping, the apparatus comprising:

a) a conveyor system having first and second conveyor portions defining a horizontal path for the conveyor of a product received in a wrapping film, said horizontal path having a predetermined gap separating said first and second conveyor portions;

b) means for depositing a product within the folded plies of said film wrapping on the said first conveyor portion for horizontal movement over said gap separating said first and second conveyor portions;

c) film wrapping sealing and cutting assembly means vertically operable in a direction crosswise of said horizontal movement of said product in said gap to receive the movement of said product wrapped within the folded plies of the film wrapping;

d) operable means to engage said film wrapping sealing and cutting assembly means in said gap to position said film wrapping sealing and cutting assembly for adapting said assembly in said gap to changes in a dimension of a product in said folded plies of the film wrapping; and e) manual control means having an operating connection to said operable means to make adjustments in said assembly to accommodate a dimensional change in a product.

4. The apparatus set forth in claim 3 in which said manual control means include a hand wheel exposed on the exterior of the apparatus and responsive mechanism within said conveyor system for effecting the adjustments in said sealing and cutting assembly to permit the function of said assembly at a position substantially at a mid position of the product dimension.

* * * * *

UNITED STATES PATENT AND TRADEMARK OFFICE

CERTIFICATE OF CORRECTION

PATENT NO. : 5,956,931
DATED : September 28, 1999
INVENTOR(S) : Brian R. Stork
APPARATUS FOR WRAPPING PRODUCTS It is certified that error appears in the above-identified patent and that said Letters Patent is hereby corrected as shown below:

Column 8, line 7 of Claim 4, after "dimension" insert -- change --

Signed and Sealed this

Thirteenth Day of June, 2000

*Attest:*

Q. TODD DICKINSON

*Attesting Officer*

*Director of Patents and Trademarks*